US006877195B2

(12) United States Patent
Guillot

(10) Patent No.: US 6,877,195 B2
(45) Date of Patent: Apr. 12, 2005

(54) CASKET BED FRAME ASSEMBLY

(75) Inventor: Edmond P. Guillot, Conover, NC (US)

(73) Assignee: Hickory Springs Manufacturing Company, Hickory, NC (US)

( * ) Notice: Subject to any disclaimer, the term of this patent is extended or adjusted under 35 U.S.C. 154(b) by 123 days.

(21) Appl. No.: 10/071,487

(22) Filed: Feb. 7, 2002

(65) Prior Publication Data

US 2003/0145379 A1 Aug. 7, 2003

(51) Int. Cl.[7] ..... A61G 17/00

(52) U.S. Cl. ..... 27/2; 5/201; 5/282.1; 5/285; 5/191

(58) Field of Search ..... 5/191, 282.1, 285, 5/286, 200.1, 201, 202, 203; 27/2, 12, 28; 52/656.1, 667

(56) References Cited

U.S. PATENT DOCUMENTS

| | | | | |
|---|---|---|---|---|
| 71,634 | A | 12/1867 | Oleff | |
| 87,273 | A * | 2/1869 | Martin | 5/285 |
| 264,641 | A * | 9/1882 | Dunks et al. | 5/229 |
| 268,500 | A | 12/1882 | Knowles | |
| 271,945 | A | 2/1883 | Strowger | |
| 297,868 | A | 4/1884 | Stambaugh | |
| 746,211 | A | 12/1903 | Webb | |
| 852,776 | A | 5/1907 | Druding | |
| 964,480 | A | 7/1910 | Bair | |
| 1,101,934 | A | 6/1914 | Hudry | |
| 1,288,931 | A | 12/1918 | Lavezzi | |
| 1,740,581 | A | 12/1929 | Eppihimer | |
| 1,800,793 | A | 4/1931 | Harms | |
| 1,831,108 | A | 11/1931 | Harms | |
| 1,934,425 | A | 11/1933 | Harms | |
| 2,100,393 | A | 11/1937 | Hamilton | |
| 2,142,553 | A | 1/1939 | Benoit | |
| 2,553,807 | A | 5/1951 | Brands | |
| 2,577,685 | A | 12/1951 | Houle | |
| 2,848,781 | A | 8/1958 | Slaughter | |
| 3,237,213 | A | 3/1966 | Birgbauer, Sr. | |
| 3,605,142 | A | 9/1971 | Weinhart | |
| 4,044,435 | A | 8/1977 | Acton | |
| 4,044,436 | A | 8/1977 | Patrick | |
| 4,332,064 | A | 6/1982 | Foust | |
| 4,403,380 | A | 9/1983 | Hazelett et al. | |
| 4,621,395 | A | 11/1986 | Benoit | |
| 4,881,306 | A | 11/1989 | Ernat et al. | |
| 5,615,464 | A | 4/1997 | Rojdev | |
| 6,434,804 | B1 * | 8/2002 | Cornet et al. | 27/2 |
| 6,446,406 | B1 * | 9/2002 | Sauer | 52/506.06 |

* cited by examiner

*Primary Examiner*—Sunil Singh
(74) *Attorney, Agent, or Firm*—Alston & Bird LLP

(57) ABSTRACT

An assembly for construction into a casket bed frame for supporting a body. The casket bed frame includes a rectangular frame formed of a pair of first rails and second rails wherein a plurality of corrugated metal strips extend between the second rails. The rails of the metal frame advantageously interlock at their ends to form the rectangular frame without the use of tools. A plurality of lances are spaced along each of the second rails and are configured to extend through holes in the ends of the corrugated strips for easy attachment of the strips to the second rails. The rectangular frame may be further reinforced, and the stretcher springs supported, by a pair of stretcher supports that each have crimped ends configured to extend over and embrace the first rails.

17 Claims, 5 Drawing Sheets

CASKET BED FRAME ASSEMBLY

FIELD OF THE INVENTION

The present invention is related to the field of caskets and more particularly to the field of casket bed frames.

BACKGROUND OF THE INVENTION

Caskets are containers employed for the interment of the bodies of deceased persons. Before interment, however, the body of the deceased is typically displayed for the benefit of their loved ones at a funeral. Given the state of mind of the bereaved relatives, it is highly desirable that the body be presented in a respectful and tasteful manner. Therefore, a support frame is used to support the body within the casket. The support frame elevates the body in the relatively deep casket so that the body can be viewed without having to stand adjacent and immediately over the casket opening.

Many of the support frames include devices for elevating and changing the angle of the body resting on the frame. Regardless, the frame itself is typically constructed of a set of metal, L-shaped rails that are connected at their respective ends by fasteners to form a rectangular frame. A pair of long rails extend the length of the frame and are in a parallel, spaced relationship. A pair of end rails extend the width of the frame and are also in a parallel, spaced relationship. The end rails extend between, and are connected by the fasteners to, the ends of the long rails. In between the end rails are a pair of additional support rails. The additional support rails are spaced along, and extend between, the long rails. Middle portions of the body are supported by the additional support rails, and the additional support rails further strengthen the rectangular frame. The body is also supported by a plurality of thin, flexible metal straps that extend between, and are spaced along, the end rails. Each of the straps is attached to the end rails via a pair of springs. Each spring has a hook extending through a respective hole defined in one of the end rails and a second hook extending through a hole defined at a respective end of the metal strap. In this manner, additional resilient support is provided along the length of the body.

Despite providing adequate support for the body in the casket, the support frame has some drawbacks. Assembly of the support frame requires the use of tools to rivet or fasten the various rails together. Assembly of the support frame also requires attachment of the straps to the springs, and the springs to the end rails. Once assembled, the support frame is difficult to ship as the rectangular frame does not "nest" well and takes up an inordinate amount of space. Another drawback is that the springs of the support frame are typically expensive components to purchase and manufacture.

Therefore, it would be advantageous to have a casket bed support frame which is easy to the assemble with the use of commonly available tools but still provides adequate support for the body of the deceased. Further, it would be advantageous to have a casket bed support frame which is cost-effective to produce and employs a minimal amount of expensive materials or expensive parts. It would also be advantageous to have a casket bed support frame which is easy and efficient to ship.

SUMMARY OF THE INVENTION

The present invention addresses the above needs and achieves other advantages by providing an assembly for construction into a casket bed frame for supporting a body.

The casket bed frame includes a rectangular frame formed of a pair of first rails and a pair of second rails wherein a plurality of stretcher springs formed as corrugated metal strips extend between the second rails. The rails of the metal frame advantageously interlock at their ends to form the rectangular frame without the use of tools. A plurality of lances are spaced along each of the second rails and are configured to extend through holes in the ends of the corrugated strips for easy attachment of the strips to the second rails. The rectangular frame may be further reinforced, and the stretcher springs supported, by a pair of stretcher supports that each has crimped ends configured to extend over and embrace the first rails.

In one embodiment, the assembly for construction into a casket bed frame for supporting a body includes a plurality of elongate flexible members, a pair of first rails and a pair of second rails. The pair of first rails each has a pair of opposing first rail ends, wherein each of the first rail ends has an L-shaped cross-section. The pair of second rails each has a pair of opposing second rail ends. Each of the second rail ends defines therein an L-shaped opening sized to receive one of the first rail ends allowing the rails to be interlocked into a rectangular frame. Spaced along each of the second rails are a plurality of attachment sites. The attachments sites are each configured for attachment of one of the flexible members so that the flexible members are supported by, and extend between, the second rails.

In another aspect, the L-shaped cross-section of the first rails includes a bottom flange and the second rails each includes a bottom surface positioned below the L-shaped opening therein. The bottom surface supports the bottom flange of the first rail end when the first and second rails are interlocked. Support by the bottom surface of the bottom flange provides improved bending strength for the interlocking connection.

In yet another aspect, the casket bed frame assembly also includes a pair of stretcher supports. Each of the stretcher supports has a pair of ends configured to be crimped onto the first rails. When in place, the stretcher supports extend between the first rails and under the elongate flexible members, thereby providing additional support for the body.

In still another aspect, the assembly includes a plurality of lances spaced along each of the second rails. Also, the elongate flexible members may be corrugated metal strips each end of which defines a hole. The lances are configured to extend through the holes at the ends of the corrugated strips for attachment of the corrugated strips. Once attached to the lances, the corrugated strips extend between the opposing pairs of lances and can flexibly support a body disposed thereon.

The present invention has several advantages. Assembly of the casket bed frame, including interlocking the rails to form the rectangular frame, attaching the ends of the corrugated metal strips to the lances on the second rails and crimping of the ends of the stretcher supports, can be performed by hand with commonly available tools. The configuration of the assembly allows the parts of the casket bed frame to be shipped in a nested arrangement, such as when the L-shaped rails are stacked on top of one another. Shipping of the disassembled casket bed frame is generally more space and cost effective than shipping the assembled frame. Further, the corrugated metal strips are typically less expensive to manufacture, and require fewer steps to assemble, than coil spring and metal strip combinations.

BRIEF DESCRIPTION OF THE DRAWINGS

Figure 1:
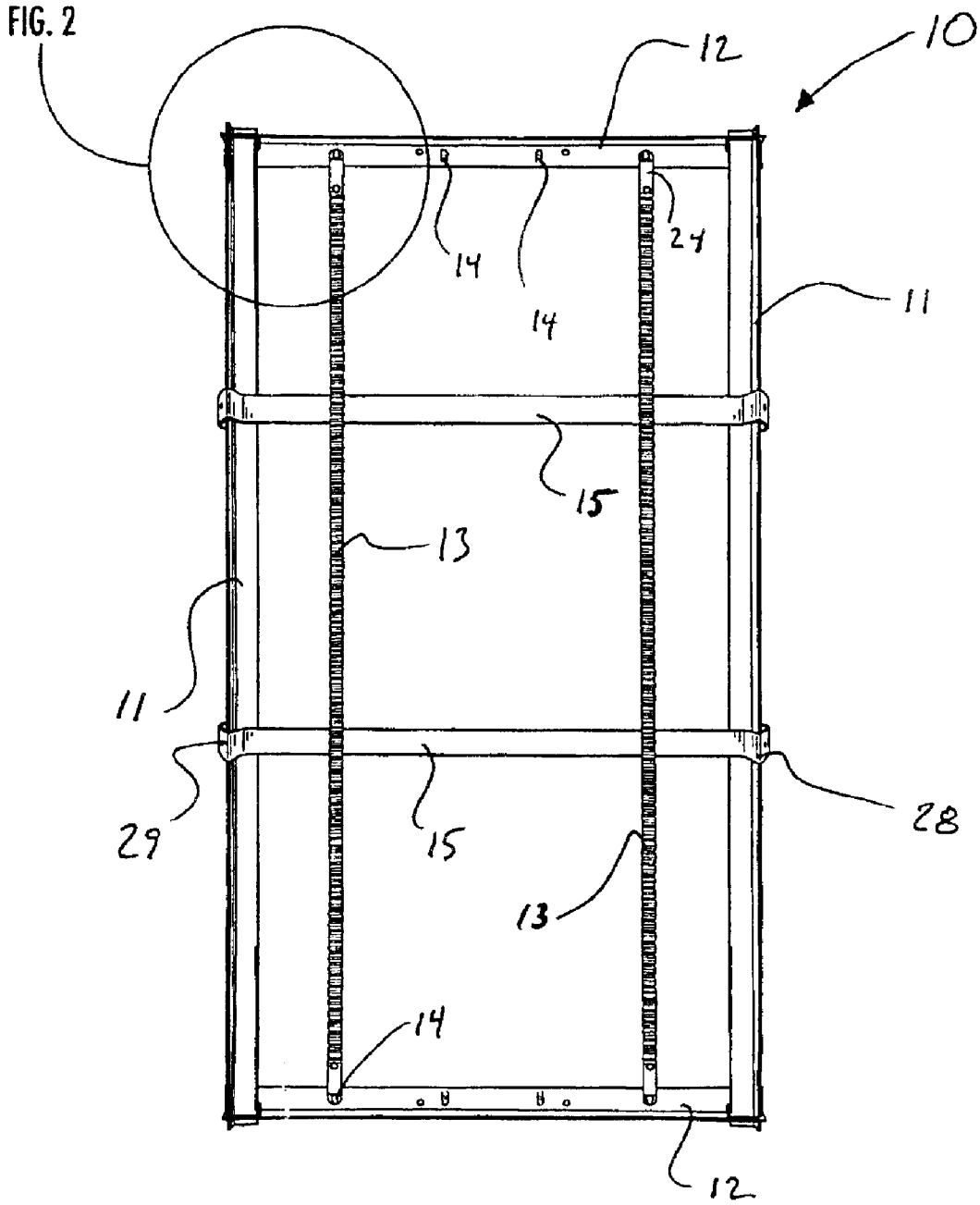
Figure 2:
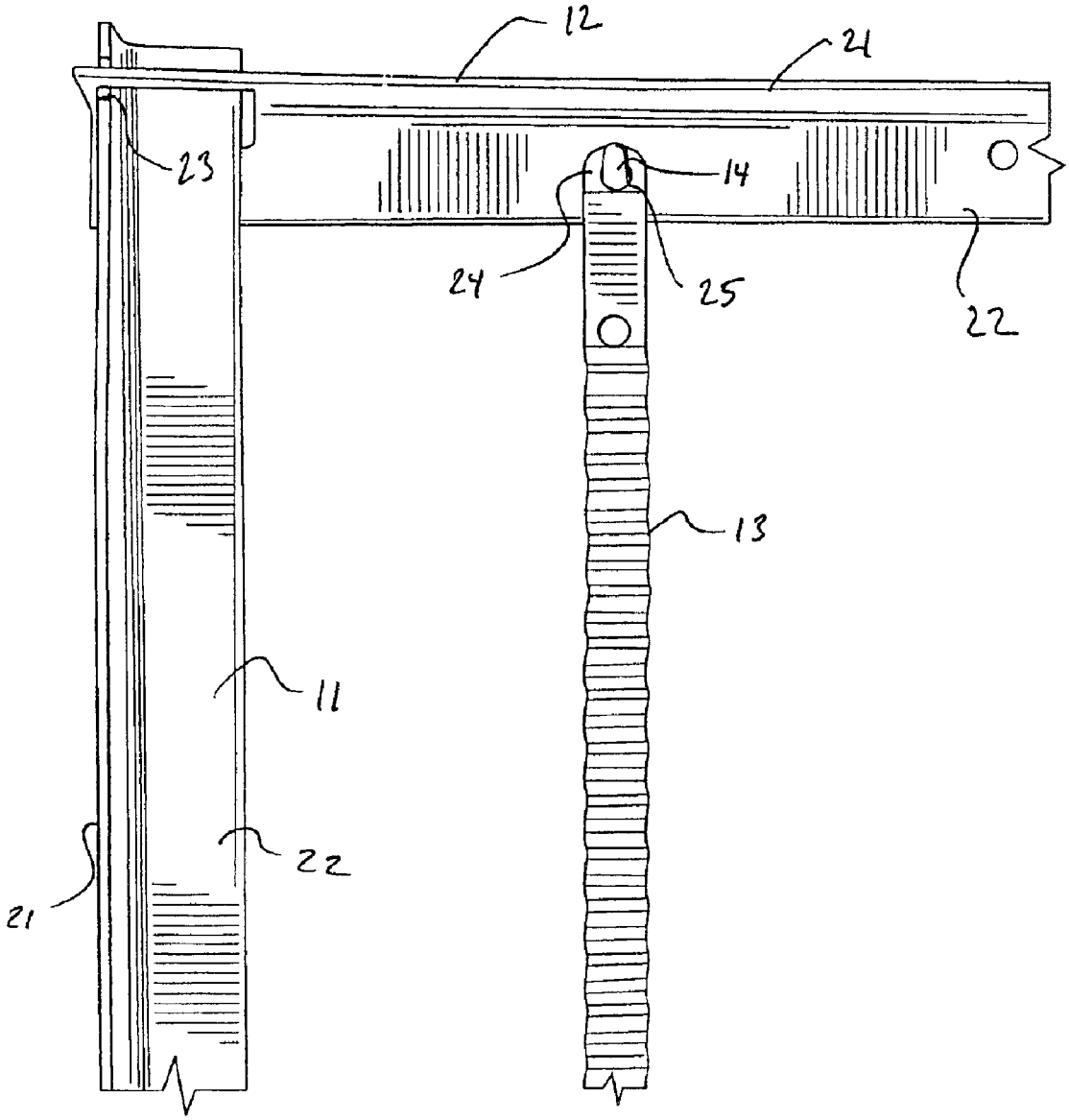
Figure 3:
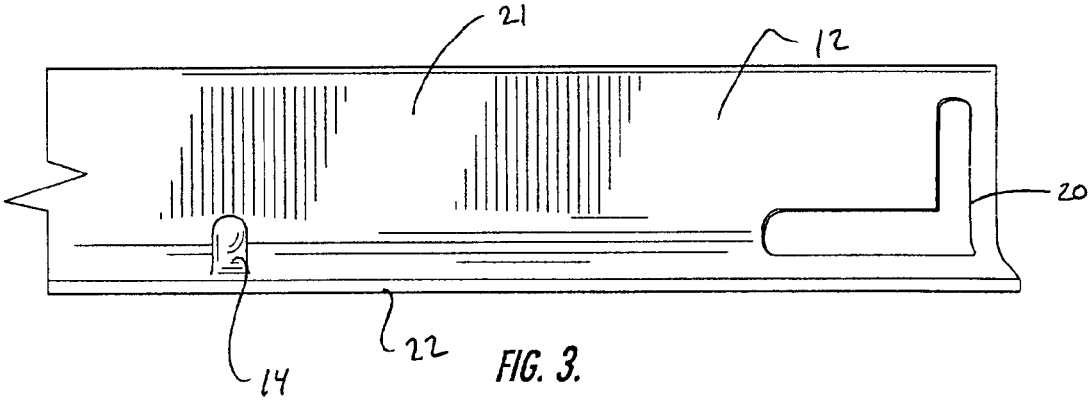
Figure 4:
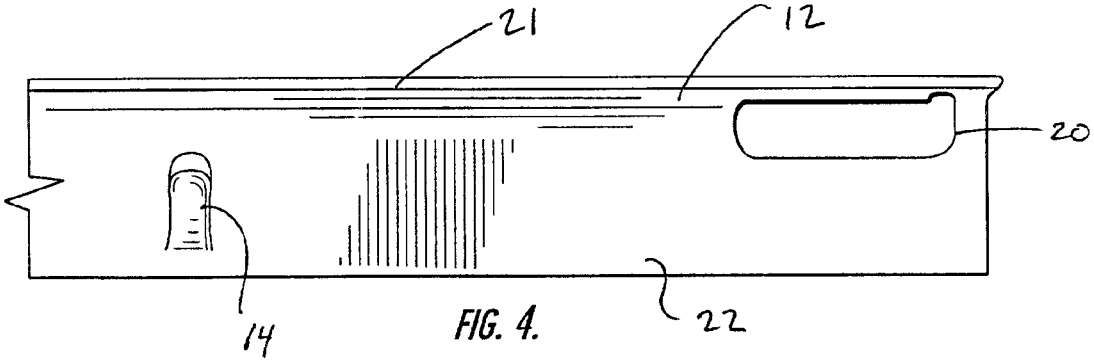
Figure 5:
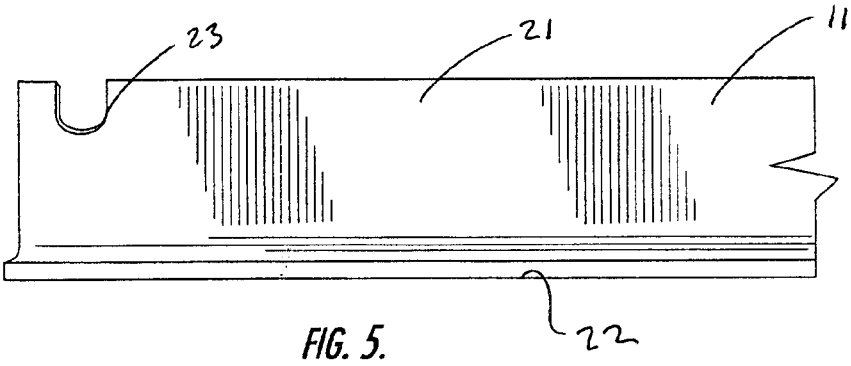
Figure 6:
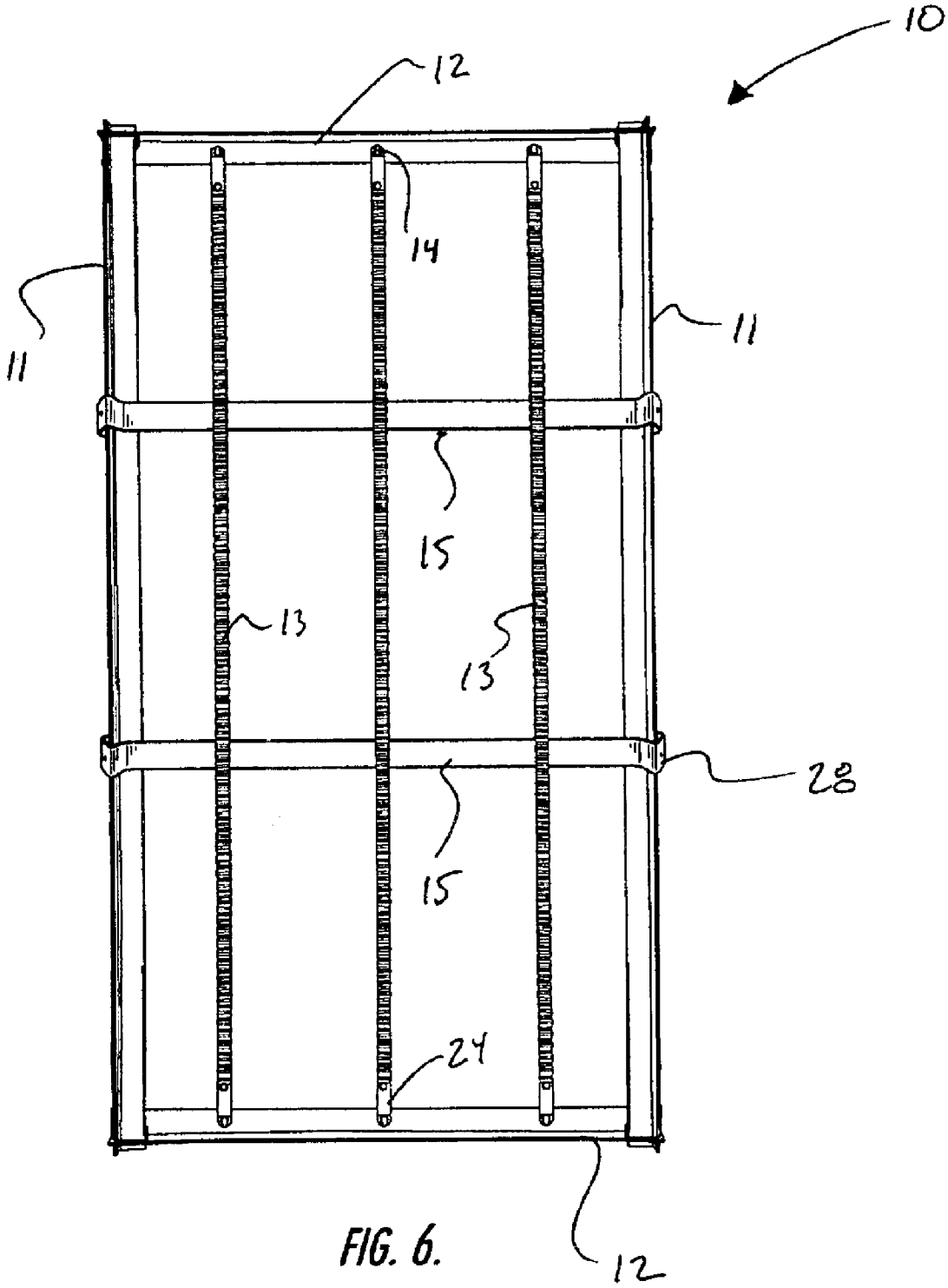
Figure 7:
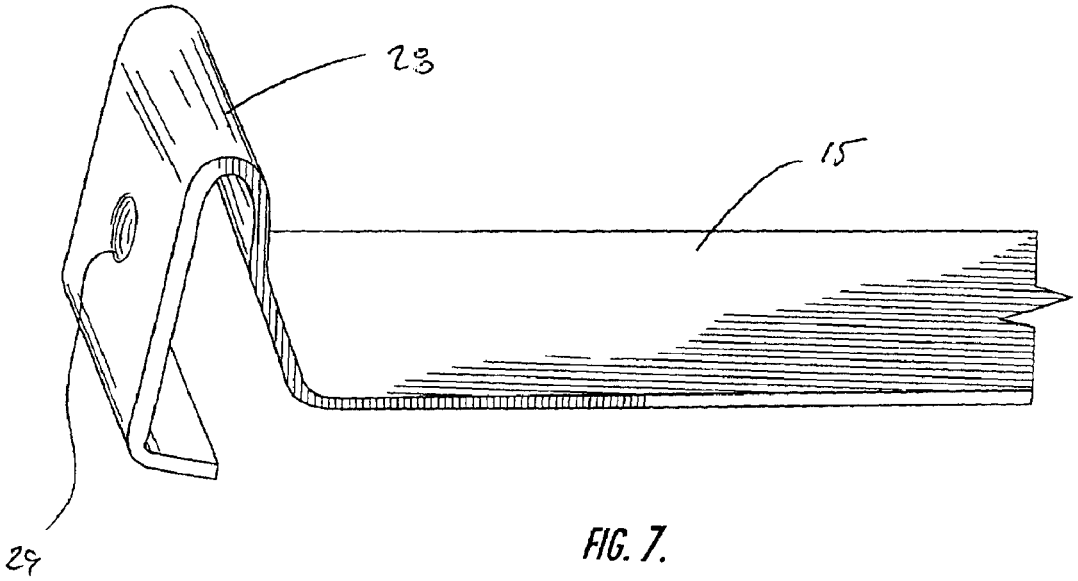

Having thus described the invention in general terms, reference will now be made to the accompanying drawings, which are not necessarily drawn to scale, and wherein:

FIG. 1 shows a plan view of a partially assembled casket bed frame of one embodiment of the present invention;

FIG. 2 shows an enlarged view of interlocking ends of a first and second rails, and an end of a corrugated spring attached to a lance on the second rail, of the casket bed frame shown in FIG. 1;

FIG. 3 shows a side elevation view of the end of the second rail shown in FIG. 2;

FIG. 4 shows a plan view of the end of the second rail shown in FIG. 2;

FIG. 5 shows a side elevation view of an end of the first rail shown in FIG. 2;

FIG. 6 shows a plan view of a fully assembled casket bed frame of another embodiment of the present invention including three corrugated metal strips; and FIG. 7 shows a perspective view of a crimped end of the stretcher support shown in FIGS. 1 and 6.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

A casket bed frame 10 of the present invention includes a pair of first rails 11 interlocked with a pair of second rails 12 to form a rectangular frame, a plurality of corrugated metal strips 13 attached to corresponding lance attachments 14 on the second rails and extending between the second rails, and a pair of stretcher supports 15 crimped to, and extending between, the first rails and under the corrugated strips so as to support a body (not shown) disposed thereon, as shown in FIGS. 1 and 6.

Preferably, the first and second rails 11, 12 each has an L-shaped cross-section that allows them to be stacked in a nested arrangement for shipping, as shown in FIGS. 3–5. In addition, the L-shaped rails have excellent bending strength while still generally requiring less material to construct than other types of rails. To allow the first and second rails to interlock, each of the second rails includes a pair of L-shaped openings 20 adjacent its ends and sized to receive the correspondingly shaped ends of the first rails, as shown in FIG. 2.

Advantageously, when assembled the L-shaped rails 11, 12 each has a top, vertically oriented flange 21 and a bottom, horizontally oriented flange 22. Having the horizontally oriented flange 22 of the rails on the bottom allows for improved downward bending strength which is the same as the direction of loading when the body is resting on the casket bed frame 10. In addition, the bottom flanges 22 of each of the L-shaped rails 11, 12 overlap in an area adjacent the L-shaped openings 20, which increases the stability of the interlocking connection. Although rails with L-shaped cross-sections are preferred for The above-listed reasons, rails with other shapes having ends tailored to interlock could be used so as to achieve quick assembly with the use of tools.

Each of the first rails 11 includes a pair of spaced apart notches 23 wherein one notch is defined at each end in the top edge of the vertical flange 21, as shown in FIG. 5. The notches 23 are positioned at the top edge of the vertical flange 21 so as to be able to receive a portion of the vertical flange of the second rail 12, as shown in FIG. 2. In particular, the portion of the vertical flange 21 is the portion defining the top edge of the vertical leg of the L-shaped opening 20. Once this portion of the second rail vertical flange 21 is received in its respective one of the notches 23, the rails are more securely interlocked against relative sliding and bending motions.

The corrugated metal strips 13 are preferably constructed of a relatively low tempered steel that is typically less expensive than higher tempered spring steel. The corrugations in the metal strips provide additional resiliency over conventional flat metal strips, obviating the need for coil springs at the ends of the strips. Generally, the preferred low tempered steel strips have a relatively low stiffness and therefore promote the use of smaller corrugations which are not likely to twist as the body is shifted laterally on the strips. Alternatively, higher tempered steel strips with larger corrugations could also be used to support the body. In addition, other metals, or even non-metal materials such as plastic, could be used if the materials have sufficient strength and flexibility to support the body.

In addition to the corrugations, each of the metal strips 13 includes a pair of opposing ends 24. In each of the opposing ends is defined a hole 25 that is sized and shaped to receive a respective one of the lance attachments 14. Preferably, the lances extend upwards from the bottom flange 22 of the second rails 12 and outwards toward the vertical flange 21. Such orientation of the lances 14 ensures that the inward and downward tension on the corrugated strips 13 does not dislodge the ends 24 of the strips from the lances under the weight of the body. Further advantageously, the holes at the ends 24 of the corrugated strips provide an improved attachment over hook attachments which may bend and dislodge.

Further preferably, the lances 14 are evenly spaced along the second rails 12 so that the attached corrugated strips 13 extend between the second rails in a parallel, spaced relationship that provides even support for the body. The number and spacing of the lances 14 and strips 13 may be varied, if desired, to provide additional support or easier assembly. For instance, four lance attachments are shown on each rail in FIG. 1 and three lance attachments are shown on each rail in FIG. 6. Other non-parallel arrangements of the lances 14 and strips 13 could also be used, such as positioning the lances at the corners of the rectangular arrangement of rails so that the attached strips form an "X." Also, the lance attachments 14 could be positioned on the first rails 11 with shorter strips 13 extending therebetween. Although the lances 14 have the advantage of being easy to construct, such as by using a punch on each bottom flange 22 of the second rails 12, other types of attachments could also be used. For instance, angled posts could be formed integrally with, or attached to, the second rails 12 and extend upwards and away from each other for attachment of the ends 24 of the corrugated metal strips.

The stretcher supports 15 are preferably constructed of elongate metal strips and include a pair of crimped ends 28 shaped to embrace the L-shaped first rails 11, as shown in FIG. 7. When installed, each of the crimped ends 28 extends upwards from the main body of the stretcher support over the vertical flange 21 of its respective one of the first rails 11, angles sharply downwards, extending along the back of the vertical flange and extends inwards at its end under the bottom of the horizontal flange 22. The upwardly and downwardly extending portions are moveable toward each other due to the deformability of the strip used to construct the stretcher supports. Such deformability allows the ends 28 to be crimped closed about the first rails 11 in the installed position described above, and as shown in FIGS. 1 and 6. Such crimping can be done by hand, or may require the use of a crimping tool, such as a pneumatic-cylinder powered crimping tool, depending up the strength of the person assembling the casket bed frame 10 and the stiffness of the strip used to construct the supports 15. Optionally, a dimple or hole 29 may be defined on the downwardly extending portion of each of the crimped ends 28 to allow easy gripping with the crimping tool.

The casket bed frame 10 of the present invention provides particular advantages during transport of the components of the frame from a first location, such as a factory location, to a second location, such as a retail sales or a mortuary location. At the first location, the unassembled components of several casket bed frames are stacked in piles of like components on a truck, train car or other mode of transportation. More particularly, the first rails 11 are stacked together in a nested arrangement for efficient use of space. The second rails 12 are also stacked together in a nested arrangement. In addition, the corrugated metal strips 13 are stacked in a bundle, as are the stretcher supports 15. As an alternative to bulk shipment of several casket bed frames, a single casket bed frame 10 could be shipped in a long, but relatively narrow, shipping container with the rails in an overlapping arrangement and bundled with the remaining components. Such an arrangement is particularly suited for direct mail order fulfillment on a just-in-time delivery basis. Regardless, once loaded the transport ships the unassembled frame or frames to the second location.

Upon arrival at the second location, the unassembled components are removed from the transport and/or shipping containers. If necessary, the components are divided into groups each for assembly into an individual casket bed frame 10. The rails are interlocked by inserting the L-shaped ends of the pair of first rails 11 into each respective L-shaped opening 20 defined in the ends of the pair of second rails 12, so as to form the rectangular frame. Further support is provided by crimping the ends 28 of the stretcher supports 15 onto opposing portions of the first rails 11 so that the stretcher supports extend therebetween. Each of the corrugated strips 13 is attached by looping one of its ends 24 over the lance on one of the second rails 12 and resiliently stretching the corrugated strip to extend its other end over the opposing lance on the other one of the second rails. Notably, the additional resiliency of the corrugations allow stretching for attachment without the use of intervening springs.

The present invention has several advantages. Assembly of the casket bed frame 10, including interlocking the rails 11, 12 to form the rectangular frame, attaching the ends of the corrugated metal strips 13 to the lances 14 on the second rails 12 and crimping of the ends 28 of the stretcher supports 15 can be performed by hand with commonly available tools or largely no tools at all. Such easy assembly allows the parts of the casket bed frame to be shipped in a nested arrangement, such as when the L-shaped rails 11, 12 are stacked on top of one another. Shipping of the unassembled casket bed frame 10 is generally more space, and cost, effective than shipping the assembled frame. Further, the corrugated metal strips 13 are typically less expensive to manufacture, and require fewer steps to assemble, than coil spring and metal strip combinations.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A casket bed frame assembly, comprising:

a plurality of elongate flexible members;

a pair of first rails each having a pair of opposing first rail ends, each of the first rail ends having an L-shaped cross-section;

a pair of second rails each having a pair of opposing second rail ends, wherein each of the second rail ends defines therein an L-shaped opening sized to receive one of the first rail ends allowing the rails to be assembled into a rectangular frame; and a plurality of attachment sites spaced along each rail of one of the pairs of rails wherein the attachment sites are each configured for attachment of one of the flexible members thereto so that the flexible members are supported by and extend between the pair of rails for supporting a body thereon.

2. A casket bed frame assembly of claim 1, wherein the L-shaped cross-section of each first rail includes a bottom flange and wherein the second rails each include a bottom surface positioned below the L-shaped opening configured to support the bottom flange of the first rail.

3. A casket bed frame assembly of claim 1, wherein each of the attachment sites includes a lance and each of the elongate flexible members has a pair of opposing ends, each of the ends defining a hole configured to receive the lance.

4. A casket bed frame assembly of claim 1, wherein the attachment sites are on the second rails.

5. A casket bed frame assembly of claim 4, further comprising at least one stretcher support having a pair of ends each crimped for attachment to one of the first rails so that the stretcher support extends between the first rails and under the elongate flexible members.

6. A casket bed frame assembly of claim 1, wherein the elongate flexible members are elongate metal strips having corrugations formed therein.

7. A casket bed frame assembly, comprising:

a plurality of elongate flexible members each having a pair of opposing ends, each of the ends defining therein a hole;

a pair of first rails each having a pair of opposing first rail ends, each of the first rail ends having an L-shaped cross-section;

a pair of second rails each having a pair of opposing second rail ends, wherein each of the second rail ends defines therein an L-shaped opening sized to receive one of the first rail ends allowing the rails to be assembled into a rectangular frame; and a plurality of lances spaced along each of the second rails wherein the lances are each configured to extend through the hole at one of the ends of a respective one of the flexible members so that the flexible members are supported by and extend between the second rails for supporting a body thereon.

8. A casket bed frame assembly of claim 7, further comprising at least one stretcher support having a pair of ends each crimped for attachment to one of the first rails so that the stretcher support extends between the rails and under the elongate flexible members.

9. A casket bed frame assembly of claim 8, wherein the elongate flexible members are elongate metal strips having corrugations defined therein.

10. A casket bed frame assembly, comprising:

a plurality of elongate flexible members, each of the flexible members having a plurality of corrugations including alternating ridges and grooves defined in the members;

a pair of first rails each having a pair of opposing first rail ends;

a pair of second rails each having a pair of opposing second rail ends, wherein the ends of the first and second rails are configured to interlock so as to form a rectangular frame;

a plurality of attachment sites spaced along each of the second rails wherein the attachment sites are each configured for attachment of one of the flexible members thereto so that the flexible members are supported by and extend between the pair of rails and wherein the corrugations in the flexible members extend approximately outwards from a plane defined by the rectangular frame; and at least one stretcher support having a pair of ends each crimped for attachment to one of the first rails so that the stretcher support extends between the rails and under the elongate flexible members for supporting a body thereon.

11. A casket bed frame assembly of claim 10, wherein the elongate flexible members are elongate metal strips and wherein the corrugations are defined in a to and bottom surfaces of the metal strips.

12. A casket bed frame assembly, comprising:

a plurality of elongate strips, each of the strips having corrugations including alternating ridges and grooves defined in the strips;

a pair of first rails each having a pair of opposing first rail ends;

a pair of second rails each having a pair of opposing second rail ends, wherein the ends of the first and second rails are configured to interlock so as to form a rectangular frame; and a plurality of attachment sites spaced along each of the second rails wherein the attachment sites are each configured for attachment of one of the flexible members thereto so that the flexible members are supported by and extend between the pair of rails and wherein the corrugations in the flexible members extend approximately outwards from a plane defined by the rectangular frame.

13. A casket bed frame assembly of claim 12, wherein the elongate strips are elongate metal strips.

14. A casket bed frame assembly of claim 12, wherein the elongate strips are elongate steel strips.

15. A method of constructing a casket bed frame, comprising:

interlocking a pair of first rails with a pair of second rails to form a rectangular frame including;

engaging L-shaped ends of one of the first rails into L-shaped openings defined in one end of each of the pair of second rails; and engaging L-shaped ends of another one of the first rails in L-shaped openings defined in another end of each of the pair of second rails; and attaching a plurality of strips to the second rails so that the strips extend between the second rails in a generally parallel, spaced relationship.

16. A method of claim 15, wherein attaching the plurality of strips includes positioning a hole defined on one end of each of the strips over a respective one of a plurality of lances spaced apart along one of the second rails and positioning a hole defined on another end of each of the strips over a respective one of a plurality of lances spaced apart along another one of the second rails.

17. A method of claim 15, further comprising crimping each end of at least one stretcher support onto a respective one of the first rails before attaching the plurality of strips and wherein attaching the plurality of strips includes extending the strips over the stretcher support.

* * * * *

UNITED STATES PATENT AND TRADEMARK OFFICE

CERTIFICATE OF CORRECTION

PATENT NO. : 6,877,195 B2
DATED : April 12, 2005
INVENTOR(S) : Guillot

It is certified that error appears in the above-identified patent and that said Letters Patent is hereby corrected as shown below:

Column 7,
Line 33, "to" should read -- top --.

Signed and Sealed this

Fifth Day of July, 2005

JON W. DUDAS
*Director of the United States Patent and Trademark Office*